US010669095B2

(12) United States Patent
Webb et al.

(10) Patent No.: US 10,669,095 B2
(45) Date of Patent: Jun. 2, 2020

(54) WASTE STORAGE DEVICE

(71) Applicant: Sangenic International Limited, Cramington (GB)

(72) Inventors: Ian Alexander Webb, London (GB); Mark Armstrong, Gwynedd (GB)

(73) Assignee: SANGENIC INTERNATIONAL LTD., New Castle Upon Tyne (GB)

( * ) Notice: Subject to any disclaimer, the term of this patent is extended or adjusted under 35 U.S.C. 154(b) by 430 days.

(21) Appl. No.: 14/310,793

(22) Filed: Jun. 20, 2014

(65) Prior Publication Data

US 2015/0136782 A1 May 21, 2015

Related U.S. Application Data

(63) Continuation of application No. 14/069,844, filed on Nov. 1, 2013, now abandoned, which is a continuation of application No. 13/782,087, filed on Mar. 1, 2013, now abandoned, which is a continuation of application No. 13/554,812, filed on Jul. 20, 2012, now abandoned, which is a continuation of application No. 13/315,919, filed on Dec. 9, 2011, now abandoned, which is a continuation (Continued)

(30) Foreign Application Priority Data

Oct. 23, 2003 (GB) ..... 0324764.0

(51) Int. Cl.
*B65F 1/14* (2006.01)
*B65F 1/06* (2006.01)

(52) U.S. Cl.
CPC ..... *B65F 1/1426* (2013.01); *B65F 1/062* (2013.01); *B65F 2210/126* (2013.01); *B65F 2210/1675* (2013.01); *B65F 2240/132* (2013.01)

(58) Field of Classification Search
CPC ..... B65F 1/062; B65F 1/1426
USPC ..... 220/495.06; 53/567
See application file for complete search history.

(56) References Cited

U.S. PATENT DOCUMENTS 182,173 A 9/1876 Cussen
435,638 A 9/1890 Barnes
(Continued)

FOREIGN PATENT DOCUMENTS

AU 720614 B2 6/2000
CA 2218628 A1 4/1998
(Continued)

OTHER PUBLICATIONS

English translation of Hungarian Search Report for Hungarian Application No. P 0400172, dated Oct. 20, 2004 (1 page).
(Continued)

*Primary Examiner* — Hemant Desai
*Assistant Examiner* — Chinyere J Rushing-Tucker
(74) *Attorney, Agent, or Firm* — Fish & Richardson P.C.

(57) ABSTRACT

A waste storage device includes a container in which a cassette is mounted. Tubing is pulled through the centre of the cassette to store packages separated by twists. The cassette is rotated relative to the container to provide the twists between packages by virtue of a rotatable disk and user grip portion. The package is gripped against rotation by a gripper diaphragm and is guided towards a wall of the container by a guide diaphragm to prevent untwisting between packages.

13 Claims, 7 Drawing Sheets

Related U.S. Application Data of application No. 13/095,307, filed on Apr. 27, 2011, now abandoned, which is a continuation of application No. 12/905,790, filed on Oct. 15, 2010, now abandoned, which is a continuation of application No. 12/788,704, filed on May 27, 2010, now abandoned, which is a continuation of application No. 10/576,548, filed as application No. PCT/GB2004/004456 on Oct. 21, 2004, now Pat. No. 7,743,588.

(56) References Cited

U.S. PATENT DOCUMENTS 617,961 A 1/1899 Johnson
918,355 A 4/1909 McGowan
3,452,368 A 7/1969 Couper
3,536,192 A 10/1970 Couper
3,682,371 A 8/1972 Saika
3,732,662 A 5/1973 Paxton
3,746,159 A 7/1973 May
3,908,336 A 9/1975 Forslund
3,938,300 A 2/1976 Lovqvist
4,132,047 A 1/1979 Gerigk et al.
4,133,356 A 1/1979 Dillingham
4,191,226 A 3/1980 Kyte
4,202,075 A 5/1980 Michel et al.
4,422,215 A 12/1983 Liekens et al.
4,488,697 A 12/1984 Garvey
4,505,003 A 3/1985 Becker et al.
4,869,049 A * 9/1989 Richards ..... B65B 9/15 53/370
4,934,529 A 6/1990 Richards et al.
4,993,210 A 2/1991 Kollross
5,045,020 A 9/1991 Neeff et al.
5,056,293 A 10/1991 Richards et al.
5,353,716 A 10/1994 Wilbert
5,535,913 A 7/1996 Asbach et al.
5,590,512 A 1/1997 Richards et al.
5,655,680 A 8/1997 Asbach et al.
5,782,061 A 7/1998 Clazie et al.
5,813,200 A 9/1998 Jacoby et al.
5,871,037 A 2/1999 Feldt
5,884,346 A 3/1999 Hengl
5,899,049 A 5/1999 Fuss et al.
6,065,272 A 5/2000 Lecomte
6,128,890 A 10/2000 Firth
6,170,240 B1 1/2001 Jacoby et al.
6,212,701 B1 4/2001 He
6,370,847 B1 4/2002 Jensen et al.
6,516,588 B2 2/2003 Jensen et al.
6,612,099 B2 9/2003 Stravitz
6,672,472 B1 1/2004 Rockwood et al.
6,712,834 B2 3/2004 Stravitz
6,719,194 B2 4/2004 Richards
6,722,107 B2 4/2004 Morand
6,804,930 B2 10/2004 Stravitz
6,817,164 B2 11/2004 Mauffette et al.
6,851,251 B2 2/2005 Stravitz
6,901,974 B2 6/2005 Chomik et al.
6,925,781 B1 8/2005 Knuth et al.
6,931,684 B1 8/2005 Henegar
6,941,733 B2 9/2005 Chomik et al.
6,974,029 B2 12/2005 Morand et al.
6,993,891 B2 2/2006 Richards
6,994,247 B2 2/2006 Richards
7,073,311 B2 7/2006 Chomik et al.
7,100,767 B2 9/2006 Chomik et al.
7,114,314 B2 10/2006 Stravitz
7,114,534 B2 10/2006 Chomik et al.
7,146,785 B2 12/2006 Stravitz
7,178,314 B2 2/2007 Chomik et al.
7,316,100 B2 1/2008 Stravitz et al.
7,350,663 B2 4/2008 Chomik et al.
7,395,646 B2 7/2008 Salman et al.
7,406,814 B2 8/2008 Morand
7,434,377 B2 10/2008 Stravitz et al.
7,503,152 B2 3/2009 Stravitz et al.
7,503,159 B2 3/2009 Stravitz et al.
7,594,376 B2 9/2009 Chomik
7,617,659 B2 11/2009 Stravitz et al.
7,629,036 B2 12/2009 Chomik et al.
7,694,493 B2 4/2010 Stravitz et al.
7,707,808 B2 5/2010 Chomik
7,708,188 B2 5/2010 Stravitz et al.
7,712,285 B2 5/2010 Stravitz et al.
7,743,588 B2 6/2010 Webb et al.
7,757,467 B2 7/2010 Chomik et al.
2002/0078665 A1 6/2002 Salman et al.
2002/0162304 A1 11/2002 Stravitz
2002/0170275 A1 11/2002 Salman et al.
2003/0121923 A1* 7/2003 Morand ..... A47K 11/02 220/495.07
2003/0131569 A1 7/2003 Chomik et al.
2003/0154696 A1 8/2003 Morand
2003/0213804 A1 11/2003 Chomik et al.
2004/0020175 A1 2/2004 Stravitz
2004/0083681 A1 5/2004 Stravitz
2005/0016890 A1 1/2005 Tannock
2005/0044819 A1 3/2005 Chomik
2005/0106706 A1 5/2005 Chomik et al.
2005/0115207 A1 6/2005 Chomik
2005/0183400 A1 8/2005 Stravitz et al.
2005/0183401 A1 8/2005 Stravitz et al.
2005/0188661 A1 9/2005 Stravitz et al.
2005/0193691 A1 9/2005 Stravitz et al.
2005/0193692 A1 9/2005 Stravitz et al.
2005/0217214 A1 10/2005 Richardson et al.
2005/0274093 A1 12/2005 Stravitz et al.
2006/0010837 A1 1/2006 Jurus
2006/0021301 A1 2/2006 Stravitz et al.
2006/0032190 A1 2/2006 Knuth et al.
2006/0130438 A1 6/2006 Stravitz et al.
2006/0130439 A1* 6/2006 Stravitz ..... B65B 9/15 53/567
2006/0237461 A1 10/2006 Chomik et al.
2006/0248862 A1 11/2006 Morand
2006/0249418 A1 11/2006 Chomik et al.
2006/0251842 A1 11/2006 Chomik et al.
2007/0157581 A1 7/2007 Webb et al.
2007/0157582 A1 7/2007 Chomik
2007/0175182 A1 8/2007 Stravitz et al.
2007/0180798 A1 8/2007 Stravitz et al.
2007/0246465 A1 10/2007 Stravitz et al.
2009/0100806 A1* 4/2009 Morand ..... B65B 67/1277 53/567
2009/0126320 A1 5/2009 Rousso et al.

FOREIGN PATENT DOCUMENTS

CA 2275238 6/1998
CA 2366384 A1 6/2003
CA 2383799 A1 10/2003
CA 2640384 A1 4/2009
CN 1081156 1/1994
CN 2375599 4/2000
CN 2417149 1/2001
CN 2543475 4/2003
CN 2714475 8/2005
CN 2861082 1/2007
CN 2882503 3/2007
DE 19646165 A1 5/1998
DE 9319683 U1 9/2000
DE 202005015117 U1 2/2007
DE 202006004159 U1 8/2007
EP 0005660 11/1979
EP 0281355 A2 9/1988
EP 0303517 A1 2/1989
EP 0353922 A1 2/1990
EP 0356051 A1 2/1990
EP 0404484 A1 12/1990
EP 0699584 A2 3/1996
EP 0738657 A2 10/1996
EP 0963924 A2 12/1999
EP 1062167 12/2000
EP 1136357 A1 9/2001

(56) References Cited

FOREIGN PATENT DOCUMENTS

| | | | |
|---|---|---|---|
| EP | 1324919 | A1 | 7/2003 |
| EP | 1364879 | A2 | 11/2003 |
| EP | 1925570 | A1 | 5/2008 |
| EP | 2045197 | A1 | 4/2009 |
| GB | 1422594 | A | 1/1976 |
| GB | 1506428 | A | 4/1978 |
| GB | 2206094 | A | 12/1988 |
| GB | 2221445 | | 2/1990 |
| GB | 2221445 | A | 2/1990 |
| GB | 2232951 | A | 1/1991 |
| GB | 2292725 | A | 3/1996 |
| HU | P9203105 | | 9/1992 |
| HU | P0104980 | | 11/2001 |
| JP | 50-152890 | A | 12/1975 |
| JP | S50152890 | | 12/1975 |
| JP | S5429272 | | 3/1979 |
| JP | 54-029272 | A | 5/1979 |
| JP | 60184807 | | 12/1985 |
| JP | 63-123701 | A | 5/1988 |
| JP | S63123701 | | 5/1988 |
| JP | S6412002 | | 1/1989 |
| JP | H01158404 | | 6/1989 |
| JP | 1-158404 | A | 11/1989 |
| JP | H052732 | | 1/1993 |
| JP | 7025402 | | 1/1995 |
| JP | 7009804 | | 2/1995 |
| JP | 07-125802 | | 5/1995 |
| JP | 0728104 | A | 5/1995 |
| JP | 7125802 | | 5/1995 |
| JP | H08175603 | | 7/1996 |
| JP | 8217204 | | 8/1996 |
| JP | 2000247401 | A | 9/2000 |
| JP | 2002-541040 | A | 10/2000 |
| JP | 2002502784 | | 1/2002 |
| JP | 2002-226003 | A | 8/2002 |
| JP | 2003118806 | A | 4/2003 |
| JP | 2004175508 | A | 6/2004 |
| JP | 2005514295 | | 5/2005 |
| JP | 2005517606 | | 6/2005 |
| WO | 9612663 | A1 | 5/1996 |
| WO | 9817536 | A1 | 4/1998 |
| WO | 9939995 | | 8/1999 |
| WO | 0061465 | | 10/2000 |
| WO | 0220354 | A1 | 3/2002 |
| WO | 02083525 | A1 | 10/2002 |
| WO | 2002087795 | A2 | 11/2002 |
| WO | 02100723 | A1 | 12/2002 |
| WO | 03059748 | A2 | 7/2003 |
| WO | 03068635 | | 8/2003 |
| WO | 2004011164 | A2 | 2/2004 |
| WO | 2004089753 | A1 | 10/2004 |
| WO | 2005042381 | A2 | 5/2005 |
| WO | 2006028988 | A1 | 3/2006 |
| WO | 2006028989 | A2 | 3/2006 |
| WO | 2006029038 | A2 | 3/2006 |
| WO | 2006029039 | A1 | 3/2006 |
| WO | 2007028230 | A1 | 3/2007 |
| WO | 2007071054 | A1 | 6/2007 |
| WO | 2008059282 | A2 | 5/2008 |

OTHER PUBLICATIONS

International Preliminary Examination Report for PCT/GB02/02627 dated Apr. 29, 2003 (2 pages).
International Search Report for PCT/GB02/02627 dated Sep. 2, 2002 (8 pages).
International Search Report and Written Opinion of International Searching Authority for PCT/GB2004/004456 dated May 17, 2005 (13 pages).
International Search Report and Written Opinion of International Searching Authority for PCT/GB2007/004410 dated Feb. 25, 2008 (12 pages).
Manual for "inkoBaby" Refil Beholder, undated (1 page).
Manual Placed in the Packaging Material for InkoBaby nappy bin, undated (1 page).
Maskinstabi, "Geometriske Figurer og Legemer," vol. 6, 2d ed., 1981; p. 51 (3 pages).
Photographs of InkoBaby Refill and Cassette, undated (1 page).
Search Report for GB 01/14312.2 dated Apr. 8, 2002 (4 pages).
Statement from Kirsten Behrensdorff from Onskeborn, dated Jun. 4, 2003 (1 page).
Statement from Peter Behrsndorff from Layette, dated Feb. 28, 2005 (1 page).
Statement by childminder Kirsten Walter Larsen, dated Feb. 27, 2005 (1 page).
Statement by wholesale trader Kurt Pedersen, dated Feb. 28, 2005 (1 page).
Letter from K. E. Wessmann to Fimck in connection with film dispenser, dated Nov. 24, 2000 (1 page).
Letter from K. E. Wessmann to municipality of Rosenholm, dated Nov. 29, 2000 (1 page).
Statement by Manging Director K. E. Wessmann of Lamico ApS, dated Aug. 8, 2005 (1 page).
Statement by G. W. Wood, Managing Director of Bradley Carter, dated Feb. 26, 2005 (1 page).
Translation of Japanese Office Action regarding Patent Application No. 2008-286873; dated Apr. 20, 2010 (2 pages).
Translation of Japanese Office Action regarding Patent Application No. 2009-187605; dated Mar. 1, 2011 (6 pages).
Translation of Text of Second Chinese Office Action regarding Chinese Patent Application No. 201610083014.3; (2 pages).

* cited by examiner

WASTE STORAGE DEVICE

CROSS REFERENCE TO RELATED APPLICATIONS

This application is a Continuation of application Ser. No. 14/069,844 having a filing date of Nov. 1, 2013, now abandoned, which is a Continuation of application Ser. No. 13/782,087 having a filing date of Mar. 1, 2013, now abandoned, which is a Continuation of application Ser. No. 13/554,812 having a filing date of Jul. 20, 2012, now abandoned, which is a Continuation of application Ser. No. 13/315,919 having a filing date of Dec. 9, 2011, now abandoned, which is a Continuation of application Ser. No. 13/095,307 having a filing date of Apr. 27, 2011, now abandoned, which is a Continuation of application Ser. No. 12/905,790 having a filing date of Oct. 15, 2010, now abandoned, which is a Continuation of application Ser. No. 12/788,704 having a filing date of May 27, 2010, now abandoned, which is a Continuation of application Ser. No. 10/576,548 having a 371(c) filing date of Jan. 8, 2007, now U.S. Pat. No. 7,743,588 issued Jun. 29, 2010, which is a U.S. National filing under § 371 of International Application No. PCT/GB2004/004456 having an international filing date of Oct. 21, 2004, claiming priority to Great Britain Application No. 0324764.0, with a filing date of Oct. 23, 2003, and herein incorporated by reference.

FEDERALLY SPONSORED RESEARCH OR DEVELOPMENT

Not applicable.

TECHNICAL FIELD

The invention relates to a waste storage device for example storing waste such as nappies.

BACKGROUND OF THE INVENTION

One known waste storage device is disclosed in GB Patent No. 2206094 (incorporated herein by reference) and described here with reference to FIG. 1. The device is particularly useful for the storage for subsequent disposal of waste such as babies' nappies or other personal waste material. A plastics container 21 is formed with an internal flange 22 from which a cylinder 23 extends upwards. A pack consisting of a tubular core 1 inside a profusely circumferentially pleated length of flexible tubing 2 is located in the container 21 with the core 1 resting on the flange 22 and rotatable on the cylinder 23. To begin using the pack to form a series of packages of objects, which in this particular example will be considered to be babies' disposable nappies, the top of the flexible tubing 2 is pulled upwards and tied into a knot 24. This closed end can then form the bottom of a package to be formed along the length of part of the tubing. This is effected by pushing the closed end downwards inside the core 1 and cylinder 23 by the object to be packaged. As this is being done the flexible tubing 2 from the pleated length slides over the top edge 25 (FIG. 1) of the core 1 which is made sufficiently smooth to prevent the flexible tubing from being damaged. The core 1 may be approximately four inches (10.16 cm) diameter but, of course, the diameter of the flexible tubing 2 is substantially more than this.

When the object has been thrust well into the concentric core 1 and cylinder 23, the package is closed by twisting the flexible tubing 2 above the object as at 30 (FIG. 1). This is done by turning the core 1 with remaining pleated tubing thereon about the core axis. A unit 31 is formed for this purpose in that it has a depending annular flange 50 formed with an outer surface that is a taper fit in a frusta-conical inner surface 51 at the top of the core 1. The package is prevented from turning about the axis of the core during this manual twisting action by springs 52 fixed to the container 21 and projecting radially inwards to engage the package. These springs are equidistantly spaced round the container 21. Shallow grooves dividing upwardly extending ridges are formed on the frusto-conical inner surface 51 to stop slippage of the flexible tubing during the twisting operation.

By the aforesaid means, a series of connected closed packages 35 are formed and this can be continued until the pleated tubing 2 is exhausted. In the arrangement of FIG. 1 the packages collect in a bin portion 36 of the container closed at the bottom by a hinged base 53 normally held closed by a manually operable catch of suitable type. When it is desired to remove the packages from the bin portion 36 for transport to a waste disposal facility, the uppermost package is severed above its upper twisted closure 30 and the hinged base 53 opened for the removal of the packages through the end of the bin portion. Even if the twisted seals between the packages become loosened, the lid and the newly formed topmost twisted seal with prevent the escape of odors, vapors and gases to the ambient atmosphere. However, it has been found that when the tubing 2 is made of high density polyethylene the twisted joints remain remarkably tight.

A development of this arrangement is disclosed in GB 2292725 (incorporated herein by reference) and described here with reference to FIG. 2. It will be seen that an outwardly flared funnel 12 having an inlet edge 15 is detachably connected to the top of the core 1 by a taper joint 16. The funnel improves the hygiene of the device yet further because the flexible tubing 2 is drawn from the pack as an object is pushed down, over the inlet edge 15 of the funnel 12 to present a fresh and hygienic layer of tubing in the flared part of the funnel. The funnel 12 is twisted to obtain the twisted closure 30. An alternative spring arrangement 14 is shown in FIG. 2 and described fully in GB 2292725.

GB 2206094 and GB2292725 both additionally disclose a cutting arrangement for severing the tubing when it is desired to remove the packages for disposal. Referring to FIG. 3, the severing means is incorporated in the unit 31 which is a bipartite unit comprising an outer ring 55 formed with a flange 50 that locks into the top of the core 1 or funnel 12 and a disc 56 which is freely rotatable in the ring 55. The disc 56 comprises a circular transparent sheet 57, through which the user can see the twisted flexible tubing, set in an angle section ring having a horizontal flange 58 and a vertical flange 59 (FIG. 1) located between narrow flanges inside the relatively stationary flange 50. In the angle of the ring 58,59 three finger pieces 60 are fixed 120° apart above the transparent sheet 57. A cutter unit 61 is fixed beneath the flange 58. This device has an upper arcuate part 62 and a lower tapered shoe 63 with a gap between them along the major portion of their length. Close to the closed termination of this gap a metal cutter blade 64 is fixed as close as possible to the relatively stationary flange 50 so that the blade is shrouded against doing any damage to a person's fingers when the lid 31 is removed. The predominant material for the lid may be plastics material or metal. To operate the cutter unit 61, the disc 56 is turned by means of the finger pieces 60 or any other suitable finger pieces through a full revolution. In this movement the tapered shoe 63 pierces through the radially pleated taut portion 65 of the flexible tubing that flares outwards from the topmost twist 30 to the core 1. Further rotation of the disc 56 causes the cutter blade 64 to cut round the tubing material, cleanly separately the uppermost package from the flexible tubing remaining on the core 1. The cutter unit further includes a finger releasable detent operable at 120° intervals.

In a further improvement, W099/39995 (incorporated herein by reference) describes a cutter of similar type to that described above with reference to FIG. 3 but formed intergrally with a hinged lid for a waste storage container. The hinged lid swings down to close the container and as a result the cutter automatically engages the tubing allowing a simplified cutting arrangement.

Various areas for further improvement exist in relation to the known devices. Twisting of the tubing is done manually and requires direct contact of the user's hands with the tubing which can be undesirable even with the funnel arrangement described above. The existing spring arrangement for holding the tubing against rotation in some instances provides insufficient user tactile feedback as to whether a package is securely held by the springs. In addition the packaging can be held unevenly tightly around its circumference as a result of which the cutting operation can be impaired. Furthermore packages suspended beneath the springs can untwist, removing the individual seals between packages.

With the existing cutter design it can be unclear whether a full cut has been achieved without repeated checking and there is also a risk that the cutter will be rotated in the wrong direction.

With regard to the cassette design it is found that a range of different cassettes are required for different container formats. In addition it is desirable to minimize the resistance to rotation of the cassette.

The invention is set out in the attached claims.

BRIEF DESCRIPTION OF THE DRAWINGS

Embodiments of the invention will now be described, by way of example, with reference to the drawings, of which.

SUMMARY OF THE INVENTION

In overview the invention provides an improved waste storage device and cassette. The waste storage device carries an outer rotatable disk with a user grip portion. The rotatable disk engages the cassette so that the cassette can be manually twisted or rotated without the need to touch the cassette itself or the tubing and with minimum difficulty.

The twisting operation is yet further improved by replacing the springs in conventional versions with an annular upper gripping diaphragm having a central aperture. As a result the package is held firmly and continuously around it periphery against twisting such that individual packages are more efficiently sealed. It is also found that this arrangement provides better user tactile feedback and holds the tubing more firmly allowing improved cutting. A further, lower guide diaphragm includes a central aperture defining a triangular flap directed towards a wall of the container such that as a package is passed through the aperture it is pushed towards the side of the container and held against it so the tubing does not untwist in the lower part of the container.

The cutter is provided in the lid but includes a single rotational detent which engages after each 360° turn so that the user can identify when one full twist has been carried out representing a full cut. Yet further the cutter has a ratchet arrangement such that it rotates only in the cutting direction.

In a further improvement the cassette is designed to suspend from an annular flange around its outer cylindrical wall as a result of which it can be mounted in plurality of different types of container formats, and also provides low frictional resistance to rotation.

DETAILED DESCRIPTION OF THE INVENTION

Figure 1:
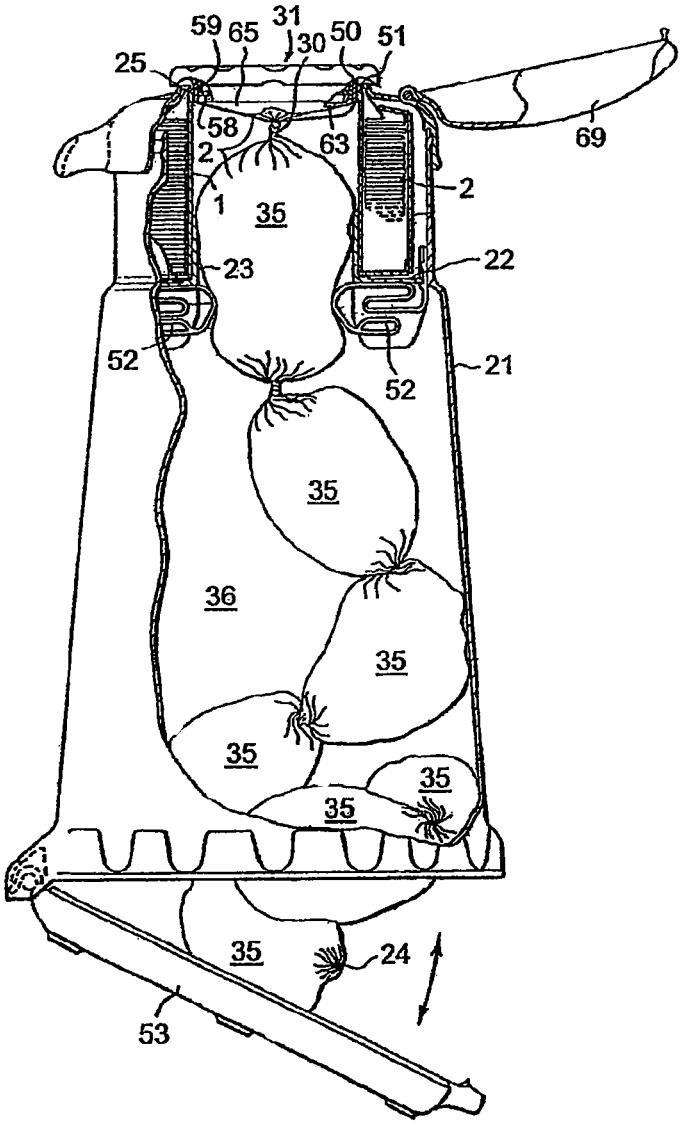
FIG. 1 PRIOR ART
FIG. 1 is a partially cut away side view of a device of known type.
Figure 2:
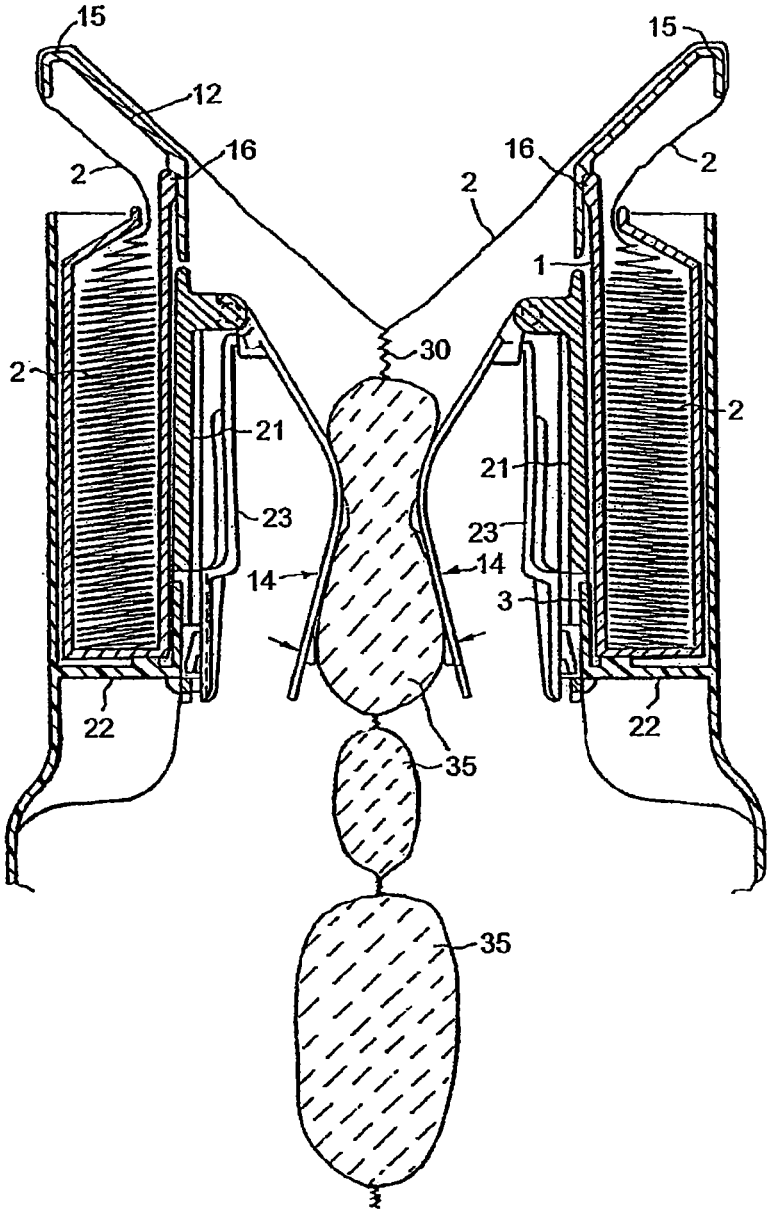
FIG. 2 PRIOR ART
FIG. 2 is a partial sectional side view of another device of known type.
Figure 3:
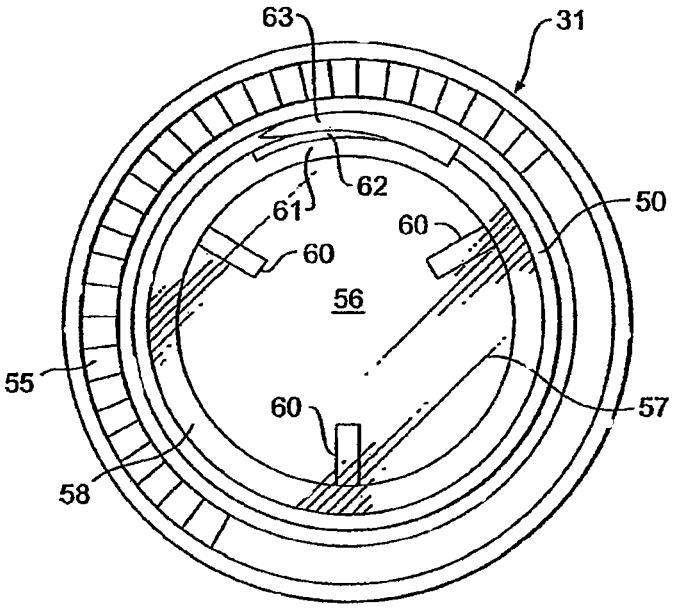
FIG. 3 PRIOR ART
FIG. 3 is an underneath plan view of a cutting device of known type.
Figure 4:
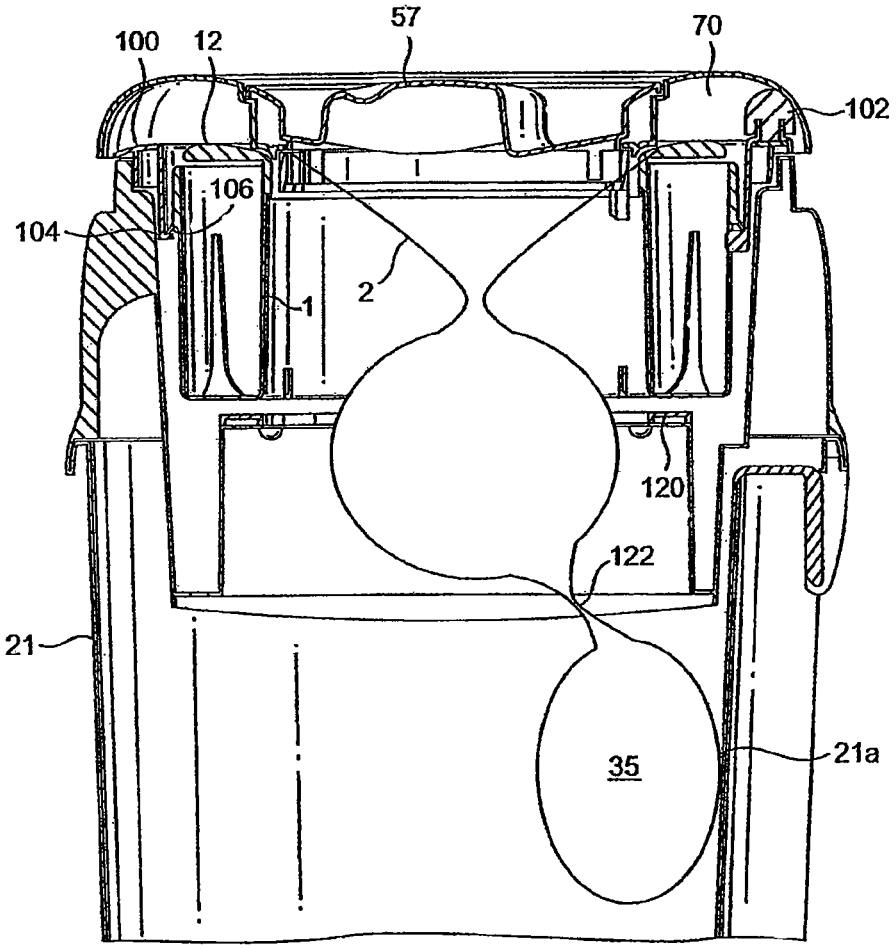
FIG. 4 is a cross-sectional view of a waste storage device according to the present invention.

Referring to FIG. 4 the device can be seen in more detail. The basic operation is as described above with reference to FIGS. 1 to 3 and will not be discussed here in detail to avoid duplication. Similarly common reference numerals denote common parts. The device includes a container 21 in which a cassette 1 is mounting from which tubing 2 is drawn down over a funnel 12. The funnel 12 is a push fit into the cassette, providing a reliable interference fit. The top part of the tubing is shown schematically and transparently for ease of understanding of the drawing and it can be seen that the tubing contains packages 35 such as nappies separated by twists.

The device includes a rotatable spinner or disk 100 with a handle 102. The disk 100 is mounted for a rotation on an annular rim of a formation on the container 21. The cassette 1 has an annular flange 106 around its outer wall resting on the shoulder 104 such that rotation of the disk 100 rotates the cassette to provide the twist in the tubing 2. In an alternative embodiment (not shown) the annular flange 106 on the cassette rests on a formation in the container itself and the disk 100 includes formations such as lugs engaging cooperating formations such as notches in the cassette. In either event a simpler means of rotating the cassette, and with less resistance to rotation, is provided.

A hinged lid 70 is further provided on the container 21. The hinged lid 70 includes an integral cutter 57 which engages the tubing 2 against the funnel 12 when the lid 70 is closed to allow cutting of the tubing in the manner discussed above with regard to FIG. 3. The specific configuration of the cutter according to the present invention is described in more detail below.

The container further includes an upper gripping diaphragm 120 and a lower, guide diaphragm 122 mounted on appropriate formations on the container provided in a throat portion of the container 21 below the cassette and formed of flexible material. The upper gripping diaphragm 120 has a central aperture which can be for example circular or circular with lobes as discussed in more detail below and is arranged to hold a package against rotation of the cassette by the rotating disk 100. The lower guide diaphragm 122 has a V-shaped slit as discussed in more detail below ensuring that when a package 35 is pushed through it is directed towards, and engages the side of the container 21 to prevent rotation and untwisting. It will be seen that the diaphragm 122 directs the package 35 towards a side having an additional set-in inner wall or fluted portion 21*a* to facilitate contact with the package 35. It will be noted that the hinged lid, rotating disk, cassette and upper and lower diaphragms are all provided on a top portion of the container 21 which can be removed from a lower portion of the container 21 to allow removal of waste stored in the container 21. The two parts can be held together by any appropriate catch means, and optionally the catch also provides an integral handle for moving the container as a whole.

Figure 5:
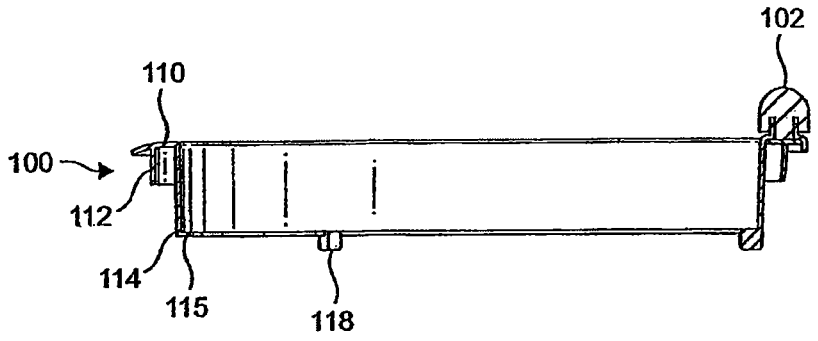
FIG. 5 is a cross-section of a rotatable disk for rotating a cassette according to the present invention.
Figure 6:
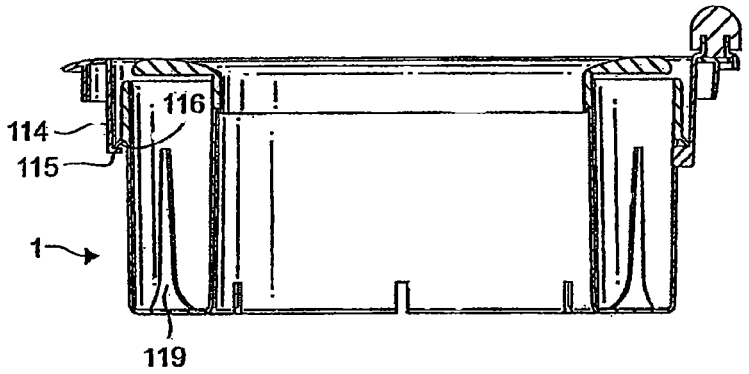
FIG. 6 is a cross-sectional view of the rotatable disk of FIG. 5 carrying a cassette.

The rotatable disk and cassette assembly is described in more detail with reference to FIGS. 5 and 6. The rotatable disk 100 includes an upper annulus 110 carrying a post upon which the handle 102 is mounted to spin freely for ease of rotation of the disk 100 by a user. An outer cylindrical wall 112 depends from the annulus 110, the lower face of which is supported on a support face of the container as can be seen in FIG. 4. An inner cylindrical wall 114 depends from an inner edge of the annulus 110 and has an inwardly projecting annular support flange 115 providing the shoulder 104 at its base supporting, as can be seen from FIG. 6, the cassette 1. The cassette 1 has an outwardly projecting annular flange or lip 116 on its outer wall resting on the support flange 115. In addition a lug 118 projecting from a lower face of the outer cylindrical wall engages in a recess or aperture 119 in the cassette 1 ensuring full rotational engagement. The recess 119 can, for example, also serve as a vent allowing air to escape when tubing is inserted into the cassette during the manufacturing process. Alternatively the cassette can carry a plurality of axially directed ribs around its outer periphery which engage with a co-operating lug or other formation on the rotatable disk 100. The upper annulus 110 can include a cutaway portion allowing the user to access the tubing to pull it out and through the central aperture of the cassette. The tubing may also carry coloring or another indicator at its lower end as an out-of-stock indicator to display to the user when it is nearly depleted.

Figure 7:
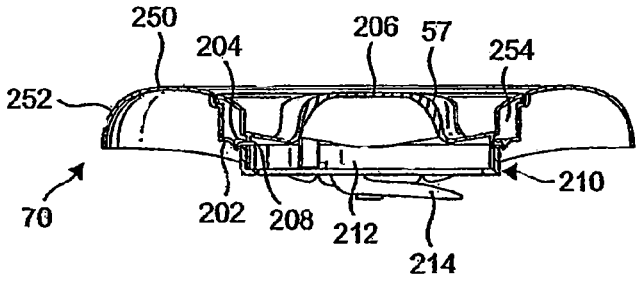
FIG. 7 is a cross-sectional view of a cutter and lid according to the present invention.

Referring now to FIG. 7 the hinged lid 70 can be seen in more detail as including a disk-shaped rim portion 250 having an external downwardly curved peripheral lip 252 and a downwardly domed inner periphery portion 254 forming a central circular aperture having an inner generally horizontal annular flange 202 with an inner upwardly projecting cylindrical guide lip 204. The cutter 57 includes a handle portion 206 comprising a generally circular body with appropriate grip portions (not shown) mounted rotatably against the hinged lid guide lip 204 and comprising a co-operating inner lip 208 engaging against the guide lip 204 to form a rotation guide. Depending from the handle portion 206 a cutter portion 210 comprises a cylindrical disk 212 with a shoe 5 214 projecting therefrom carrying a blade (not shown) as discussed in more detail above with reference to FIG. 3. Rotation of the handle portion 206 turns the cutter portion 210 relative to the tubing such that the shoe 214 catches the tubing 2 which rides up to the blade and is cut by continued rotation of the cutter. In an optimization two blades and respective shoes are provided at 180° intervals around the cutter ensuring that the film is cut all the way around with a single turn of the cutter.

Figure 8:
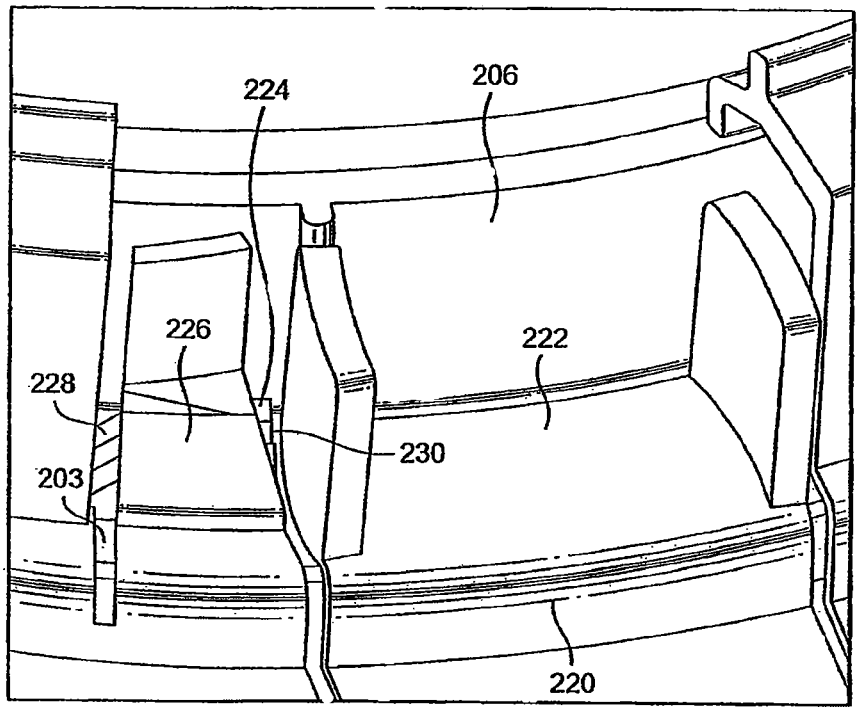
FIG. 8 is a perspective view of a detail of the lid and cutter assembly according to the present invention.

Referring to FIG. 8 a tamper proof tab 220 provided on the hinged lid 70 can be seen in more detail, viewed from the underside of the lid. The tamper proof tab 15 220 is resiliently mounted on the lid for example relying on the resilience of the lid material and biased upwardly against downward finger pressure. The tab 220 includes a tongue 222 arranged to engage a corresponding projection 224 on a lower, underside face 203 of the cutter handle portion 206. When the tab is depressed the projection 224 is disengaged allowing rotation of the cutter with the tab released until the projection 224 has rotated around 3600 and provides a stop against the tab tongue 222. As a result a single 360° turn is permitted allowing the user to ensure that a full cut has been achieved.

In addition a ratchet-type arrangement is provided to ensure uni-directional rotation of the cutter handle portion 206. One way tab 226 is also resiliently biased against downward movement for example relying on the resilience of the material from which the lid and tab are formed. Accordingly in a rest position the one way tab 226 engages or is in close proximity to the lower face 203 of the cutter handle portion 206 allowing rotation of the cutter handle portion. The projection 224 on the cutter handle portion additionally has a ramp face 228 and a detent face 230 to provide a ratchet. As a result, if the cutter is rotated in the correct direction, the one-way tab 226 rides over the ramp face 228. However, if the cutter is rotated in the wrong direction, then the one-way tab 226 engages the detent face 230 and prevents rotation in that direction. As a result, the cutter can only be rotated in the cutting direction. It will be appreciated that the tab detent and ratchet mechanisms can be combined in a single element.

Figure 9:
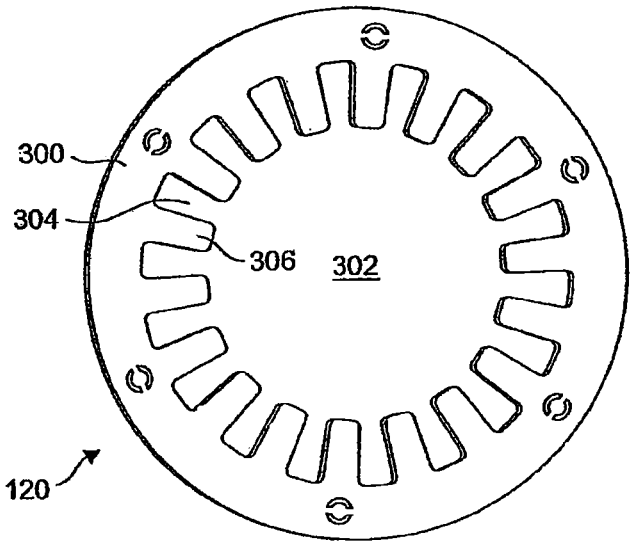
FIG. 9 is a plan view of an upper, gripping diaphragm according to the present invention.

Referring now to FIG. 9, the upper, gripping diaphragm can be seen in more detail as comprising a main body 300 having a central aperture 302. The central aperture 302 can be circular or of any other appropriate profile and here it can be seen that the circular aperture 302 includes a number of lobes 304 such that the main body 300 has a plurality of projecting fingers 306 projecting into the aperture 302 effectively forming a continuous engagement face but providing additional flexibility. As a result, the upper gripping diaphragm 120 provides a clear engagement feel when a package is inserted and held in place so that the user can detect by tactile feedback that the arrangement is ready to twist the tubing above the gripped package. Yet further, the effectively continuous engagement face provided by the aperture periphery such as fingers 306 ensures that the tubing is gripped consistently around its circumference such that the cutting operation is performed more efficiently, less loose portions of the tubing being encountered by the cutter.

Figure 10:
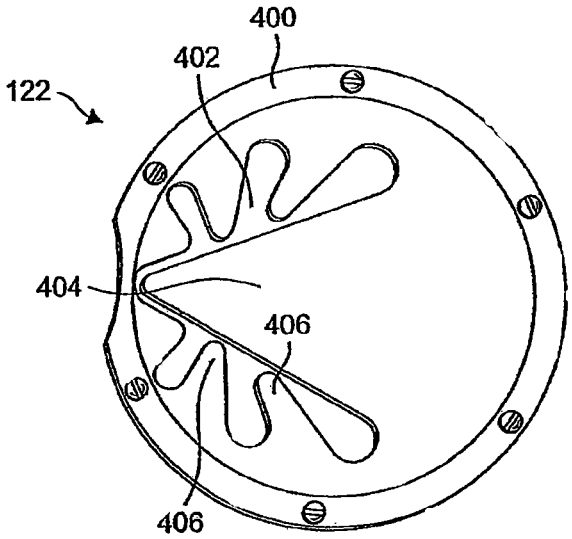
FIG. 10 is a plan view of a lower, guide diaphragm according to the present invention.

Referring now to FIG. 10, the lower, guide diaphragm 122 comprises a main body 400 formed of flexible material and including a V-shaped aperture 402 provided off centre to define a triangular flap 404 whose tip is near the circumference of the main body 400. As a result, packages being pressed down through the aperture 402 are generally directed by the flap in the direction of its tip towards the wall of the container beneath it. As a result the package is held against the container wall such that it will not untwist whilst suspended in the container. It will be seen that the aperture 402 defines a plurality of a fingers 406 which improve the flexibility of the arrangement and provide additional guides to the package being pushed through the diaphragm.

It will be appreciated that the device and components described above can be formed from any appropriate materials and in any appropriate manner. For example the majority of the parts can be formed from resilient or rigid plastics material, and the upper and lower diaphragms from flexible elastomeric material such as an elastomeric polymer.

Although discussion has been directed to provision of the waste storage device for storage of nappies, it will be appreciated that any appropriate waste such as 15 hygienic waste or household waste can be stored and packaged as described above. Similarly the device can be used in any appropriate environment for example domestic, workplace, retail, public, hospital or care environments. Any appropriate detent and ratchet mechanism can be used for control of the rotating cutter portion. The rotating disk for rotating the cassette can be mounted and rotated in any appropriate manner and can indeed be formed integrally on an outer face of the cassette. The guide and gripping diaphragms can have any appropriately defined central aperture and be formed of any appropriate flexible or semi-flexible material.

We claim:

1. A waste storage cassette for use with a container, the container being separate from the cassette, the container having an annular disk mounted on and forming a portion of the container, with the annular disk portion of the container being separate from the cassette, the annular disk portion of the container having a plurality of engagement lugs being formed on and spaced around the annular disk portion of the container, the cassette comprising:

(A) flexible waste storage tubing;

(B) a generally tubular cassette housing defining a bottom wall, an inner wall, and an outer wall of the cassette;

(C) a cassette funnel attached to the cassette housing, the cassette funnel defining a top wall of the cassette; and (D) the top wall, the bottom wall, the inner wall, and the outer wall of the cassette defining a waste storage tubing receptacle therebetween, the inner wall of the cassette having a central portion through which, in use, the waste storage tubing passes, the cassette further including a plurality of apertures, wherein the apertures located on the cassette are shaped and spaced to cooperatively and removably engage the engagement lugs of the annular disk portion of the container.

2. The waste storage cassette of claim 1, further comprising:

(A) the cassette funnel having a generally annular shape;

(B) a generally annular slot in the top wall;

(C) a portion of the flexible tubular sheet is extendable beyond the cassette; and (D) wherein engagement of the apertures of the cassette with the engagement lugs of the annular disk portion of the container prevents the cassette from rotating relative to the annular disk portion of the container so as to facilitate rotation of the portion of the flexible tubular sheet relative to the cassette.

3. The waste storage cassette of claim 2, further comprising:

(A) the flexible waste storage tubing being located in the waste storage tubing receptacle; and (B) the flexible waste storage tubing being removable from the waste storage tubing receptacle through the annular slot.

4. The waste storage cassette of claim 3, further comprising:

(A) the top wall including cutaway portions adjacent to the annular slot adapted to facilitate removal of the flexible waste storage tubing from the waste storage tubing receptacle through the annular slot; and (B) the flexible waste storage tubing being made from high density polyethylene.

5. A cassette for dispensing material usable for storage and disposal of used diapers or other personal waste, the cassette being engageable with and removable from a container that is separate from the cassette, the container having an annular disk mounted thereon and forming a portion of the container, with the annular disk portion of the container being separate from the cassette, and the annular disk portion of the container having an engagement lug on the annular disk portion of the container, and the cassette being capable of being removably engaged with the engagement lug of the annular disk portion of the container, comprising:

(A) the cassette having a cassette housing embodying a generally annular and generally tubular shape, the cassette having an inner wall, an outer wall, and a bottom wall defined by the cassette housing;

(B) the cassette having a cassette funnel attached to the cassette housing and defining a top wall of the cassette;

(C) the cassette housing having a hollow interior compartment;

(D) the bottom wall of the cassette being attached to the inner wall of the cassette and to the outer wall of the cassette, and the cassette further including an aperture spaced and shaped such that the engagement lug of the annular disk portion of the container can cooperatively and removably engage in the aperture of the cassette;

(E) the top wall of the cassette being generally annular in shape;

(F) a generally annular slot in the top wall of the cassette;

(G) a central opening extending through the cassette and having a generally circular cross-section, the central opening being at least partially defined by the inner wall of the cassette; and (H) a flexible tubular sheet having an inner sheet surface, the flexible tubular sheet being located in the hollow interior compartment, wherein:

(1) the flexible tubular sheet is arranged such that the inner sheet surface surrounds the inner wall of the cassette; and (2) the flexible tubular sheet is removable from the hollow interior compartment through the annular slot of the cassette.

6. The cassette of claim 5, the cassette being engageable with and removable from the annular disk portion of the separate container, wherein a plurality of engagement lugs are spaced on the annular disk portion of the container, further comprising:

a portion of the flexible tubular sheet is extendable beyond the cassette; and the cassette includes a plurality of apertures spaced and shaped such that the plurality of the engagement lugs of the annular disk portion of the separate container can cooperatively engage in the plurality of the apertures of the cassette, whereby the cassette is prevented from rotating relative to the annular disk portion of the container so as to facilitate rotation of the portion of the flexible tubular sheet relative to the cassette.

7. The cassette of claim 6, wherein:

the cassette top wall defined by the cassette funnel further comprises cutaway portions adjacent to the annular slot adapted to facilitate removal of the flexible tubular sheet from the hollow interior compartment through the annular slot.

8. The cassette of claim 7, wherein:

the flexible tubular sheet is made from high density polyethylene.

9. The cassette of claim 6, wherein:

the flexible tubular sheet is made from high density polyethylene.

10. A cassette for dispensing material usable for storage and disposal of used diapers or other personal waste, the cassette being engageable with and removable from an annular disk mounted on and forming a portion of a container that is separate from the cassette, wherein the annular disk portion of the container is separate from the cassette, the annular disk portion of the container having engagement lugs shaped and spaced thereon, comprising:

(A) a cassette housing having a generally annular and generally tubular shape, the generally annular shape of the cassette housing being centered on a cassette central axis extending transversely through the cassette, and wherein the cassette housing includes a hollow interior compartment extending entirely around the cassette central axis, the cassette further comprising:

(1) the cassette housing defining a cassette inner wall having a generally circular cylindrical shape centered on the cassette central axis, the cassette inner wall having an inner wall inside surface, an inner wall outside surface, an inner wall top edge, and an inner wall bottom edge, the cassette inner wall having an inner wall radius measured from the cassette central axis to the inner wall inside surface, and the cassette inner wall having an inner wall circumference measured around the inner wall inside surface;

(2) the cassette housing defining a cassette outer wall having a generally circular cylindrical shape centered on the cassette central axis, the cassette outer wall having an outer wall inside surface, an outer wall outside surface, an outer wall top edge, and an outer wall bottom edge, the cassette outer wall having an outer wall radius measured from the cassette central axis to the outer wall inside surface, the outer wall radius being greater than the inner wall radius; and (3) the cassette housing defining a cassette bottom wall attached adjacent to and extending between the inner wall bottom edge and the outer wall bottom edge, the cassette bottom wall having a bottom wall inside surface and a bottom wall outside surface, (4) the cassette further comprising a plurality of cassette apertures, wherein the cassette apertures are shaped and spaced so as to be adapted to permit:

(a) cooperative engagement with and removal from the engagement lugs of the annular ring portion of the container; and (b) air to escape the hollow interior compartment through the bottom wall apertures of the cassette;

(B) a cassette funnel attached to the cassette housing defining a top wall of the cassette having a generally annular shape centered on the cassette central axis, the top wall of the cassette defined by the cassette funnel having a top wall outside surface and a top wall inside surface, wherein the top wall of the cassette defined by the cassette funnel further comprises a generally annular slot providing access to the hollow interior compartment of the cassette from outside of the cassette;

(C) a cassette central opening extending through the cassette and having a generally circular cross-section centered on the cassette central axis, the cassette central opening being at least partially defined by the inner wall outside surface;

(D) the hollow interior compartment of the cassette being further defined by the inner wall inside surface, the outer wall inside surface, the bottom wall inside surface, and the top wall inside surface; and (E) a flexible tubular sheet located in the hollow interior compartment of the cassette, wherein:

(1) the flexible tubular sheet has an inner sheet surface and an outer sheet surface;

(2) the flexible tubular sheet has an inner sheet surface dimension determined by measuring the distance around the inner sheet surface of the flexible tubular sheet;

(3) the inner sheet surface dimension of the flexible tubular sheet is greater than the inner wall circumference;

(4) the flexible tubular sheet is arranged in the hollow interior compartment such that the inner sheet surface of the flexible tubular sheet circumscribes the cassette inner wall; and (5) the flexible tubular sheet is removable from the hollow interior compartment of the cassette through the annular slot of the cassette.

11. The cassette for dispensing material usable for storage and disposal of used diapers or other personal waste of claim 10, wherein:

the cassette funnel further comprises cutaway portions adjacent to the annular slot adapted to facilitate removal of the flexible tubular sheet from the hollow interior compartment.

12. The cassette for dispensing material usable for storage and disposal of used diapers or other personal waste of claim 10, wherein:

(A) the flexible tubular sheet is made from high density polyethylene;

(B) a portion of the flexible tubular sheet is extendable beyond the cassette; and (C) wherein engagement of the cassette apertures with the engagement lugs of the annular disk portion of the container prevents the cassette from rotating relative to the annular disk portion of the container so as to facilitate rotation of the portion of the flexible tubular sheet relative to the cassette.

13. The cassette for dispensing material usable for storage and disposal of used diapers or other personal waste of claim 12, wherein:

the cassette funnel further comprises cutaway portions adjacent to the annular slot adapted to facilitate removal of the flexible tubular sheet from the hollow interior compartment.

* * * * *